US005203474A

United States Patent [19]

Haynes

[11] Patent Number: 5,203,474

[45] Date of Patent: Apr. 20, 1993

[54] BEVERAGE DISPENSING NOZZLE

[75] Inventor: Joel E. Haynes, Tarzana, Calif.

[73] Assignee: Alco Standard Corporation, Valley Forge, Pa.

[21] Appl. No.: 540,243

[22] Filed: Jun. 19, 1990

[51] Int. Cl.[5] ..... B67D 5/56

[52] U.S. Cl. ..... 222/129.1; 222/459; 239/419; 239/424

[58] Field of Search ..... 222/129.1, 129.2, 129.3, 222/129.4, 459; 239/419, 419.3, 424, 427.3

[56] References Cited

U.S. PATENT DOCUMENTS

| | | | |
|---|---|---|---|
| 1,327,162 | 1/1920 | Knight . | |
| 1,329,601 | 2/1920 | Hinsdale . | |
| 1,464,909 | 8/1923 | Kimberlin | 239/419 |
| 1,525,650 | 2/1925 | Koenig . | |
| 1,907,162 | 5/1933 | Webb . | |
| 1,923,595 | 8/1933 | Temple . | |
| 2,226,611 | 12/1940 | McCollum . | |
| 2,349,441 | 5/1944 | Lund . | |
| 2,493,660 | 1/1950 | Elkins . | |
| 2,547,423 | 4/1951 | Wegman et al. . | |
| 2,733,730 | 2/1956 | Turak . | |
| 3,182,860 | 5/1965 | Gallo, Sr. . | |
| 3,357,598 | 12/1967 | Kraft . | |
| 3,385,527 | 5/1968 | Drewry | 239/424 |
| 3,423,028 | 1/1969 | Stupakis . | |
| 3,653,548 | 4/1972 | Kotscha et al. . | |
| 3,717,284 | 2/1973 | Garrard | 222/129.1 |
| 3,830,405 | 8/1974 | Jaeger . | |
| 3,898,861 | 8/1975 | McMillin . | |
| 3,948,419 | 4/1976 | Polster . | |
| 3,966,091 | 6/1976 | Bencic | 222/129.1 |
| 4,218,014 | 8/1980 | Tracy | 239/106 |
| 4,266,726 | 5/1981 | Brown et al. . | |
| 4,270,673 | 6/1981 | Rodth | 222/129.1 |
| 4,509,690 | 4/1985 | Austin et al. . | |
| 4,765,513 | 8/1988 | McMillin et al. . | |
| 4,808,346 | 2/1989 | Strenger . | |
| 4,863,068 | 9/1989 | Smith . | |
| 4,928,854 | 6/1990 | McCann et al. | 222/145 |

*Primary Examiner*—Gregory L. Huson

*Attorney, Agent, or Firm*—Spensley Horn Jubas & Lubitz

[57] ABSTRACT

An improved nozzle for beverage dispenser assures a high flow rate (for example, approximately 6 oz/sec or more), while maintaining a high quality beverage. An accumulator chamber reduces the turbulence of the incoming liquid to reduce carbonation loss. The nozzle converts high upstream liquid velocities to very low liquid velocities within the nozzle without an attendant high pressure loss across the nozzle. The nozzle is provided with a syrup accumulator chamber and a wide orifice syrup diverter which allow syrup to gently mix with a first portion of soda water substantially simultaneously during the dispense cycle and at substantially the same relative velocity. Thereafter the mixture of syrup and the first portion of soda water is mixed with a second portion of soda water.

5 Claims, 6 Drawing Sheets

BEVERAGE DISPENSING NOZZLE

BACKGROUND OF THE INVENTION

1. Field of the Invention

The present invention relates to nozzles, and more particularly to nozzles for post-mix beverage dispensers. The present invention also relates to methods of mixing liquids by such nozzles.

2. Description of Related Art

In a post-mix beverage dispenser, the constituent ingredients of the beverage, typically two or more liquids, are mixed as they are dispensed through a nozzle. In most instances, one liquid is water saturated with carbon dioxide (usually referred to as soda water or carbonated water) and the other is a flavored syrup. Ideally, the nozzle of a dispenser should deliver a mixed liquid into a container in such a manner that the final beverage is dispensed rapidly, at the proper mixture ratio and temperature, with low foam, and good $CO_2$ retention, and is thoroughly mixed without stratification of the component liquids.

Many prior nozzles operate satisfactorily at flow rates of approximately three ounces per second. In order to increase the efficiency of the dispenser, it would be advantageous to increase the flow rate to as high as six ounces per second, or more. However, many conventional nozzles have been found to dispense poorer quality beverages having either poor $CO_2$ retention, high stratification, high foam height or high pressure loss, when subjected to high flow rates.

These deficiencies may be caused by a variety of factors. In addition to mixing the constituent liquids, the beverage dispenser nozzle reduces the high velocity flow from the valve to a very low velocity. However, in many conventional nozzles, the velocity reduction is accompanied by a corresponding pressure loss, which if high, can place significant demands upon the control valves of the dispenser. In addition, rapid pressure loss usually produces turbulence in the soda water, often causing the soda water to lose some carbonation. It has also been found that poor $CO_2$ retention can result from an abrupt change in the temperature, flow pattern or direction of the soda water.

Further, in a conventional nozzle, syrup is generally introduced into the soda water through four orthogonally directed orifices to increase the mixing of the syrup and soda water. However, because of the relatively high viscosity of the syrup and the small size of the orifices, the syrup often is retained in the orifices after the dispense cycle is completed. Consequently, at the beginning of the next dispense cycle, the retained syrup can be dispensed immediately before the soda water arrives, often resulting in increased stratification (i.e. poor mixing) and spitting of the syrup at the start of the dispense cycle. The force of the individual streams of syrup can also cause $CO_2$ loss and increased foam height.

SUMMARY OF THE INVENTION

It is an object of the present invention to provide an improved nozzle for a beverage dispenser obviating the above-mentioned limitations, particularly in a manner requiring a relatively uncomplicated mechanical arrangement.

These and other objects and advantages are achieved in a nozzle for a beverage dispenser which nozzle includes an accumulator chamber having a wall which defines an exit port for a first liquid such as soda water. The exit port is sized so that the exit rate of the first liquid from the accumulator chamber is less than the entering rate from the source of the first liquid so that the accumulator chamber accumulates the first liquid during a portion of the dispense cycle. Consequently, a stream of the first liquid entering the accumulator chamber from the first liquid source is caused to pass through the accumulated first liquid, thereby significantly reducing the velocity and turbulence of the first liquid. As a result, where the first liquid is soda water, the amount of $CO_2$ lost from the soda water solution is reduced during the dispense cycle. Furthermore, because of the velocity reduction provided by the accumulator chamber, a very low restriction diffuser may be used so that only a small pressure loss is caused across the nozzle, thereby reducing the strain on the control valve.

In another aspect of the invention, the nozzle includes a diverter, a first conduit having first and second inlets, the first inlet being coupled to the source of the first liquid (such as soda water); and a second conduit having an inlet coupled to the source of the second liquid (such as the flavored syrup), a second accumulator chamber and an outlet. In the illustrated embodiment, the diverter is a cone-shaped protrusion having an apex directed toward the outlet of the second liquid conduit, and a base directed toward the second inlet of the first liquid conduit outlet. The spacing between the diverter apex and the outlet of the second liquid conduit is sized to form an outlet orifice and an accumulator chamber in the second conduit which permits a highly viscous liquid such as flavored syrup to be delayed at the beginning of each dispense cycle, fill the syrup accumulator chamber and empty the accumulator chamber at the end of each cycle. As a consequence, the syrup arrives at a mixing chamber more contemporaneously with the soda water. The outlet orifice also allows the syrup to exit the outlet each dispense cycle to reduce spitting at the beginning of the next dispense cycle. Furthermore, the cone-shaped diverter evenly distributes the syrup about its circumference so that the syrup gently and thoroughly mixes with the soda water in the first conduit.

DETAILED DESCRIPTION OF THE INVENTION

Figure 1:
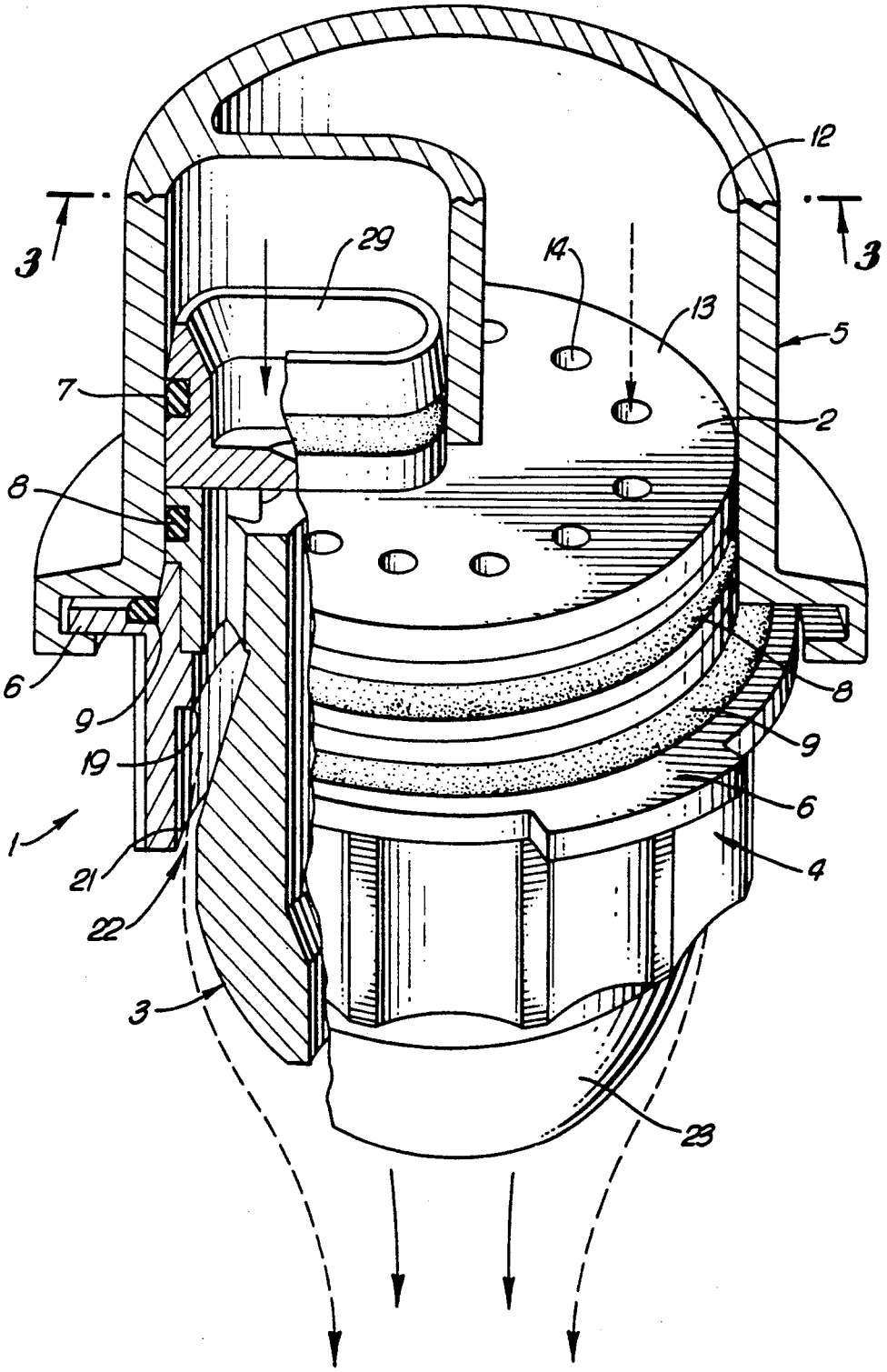
FIG. 1 is a perspective view of one embodiment of a nozzle in accordance with a preferred embodiment of the invention, with a portion broken away to show the interconnection between a valve body and the nozzle.
Figure 2:
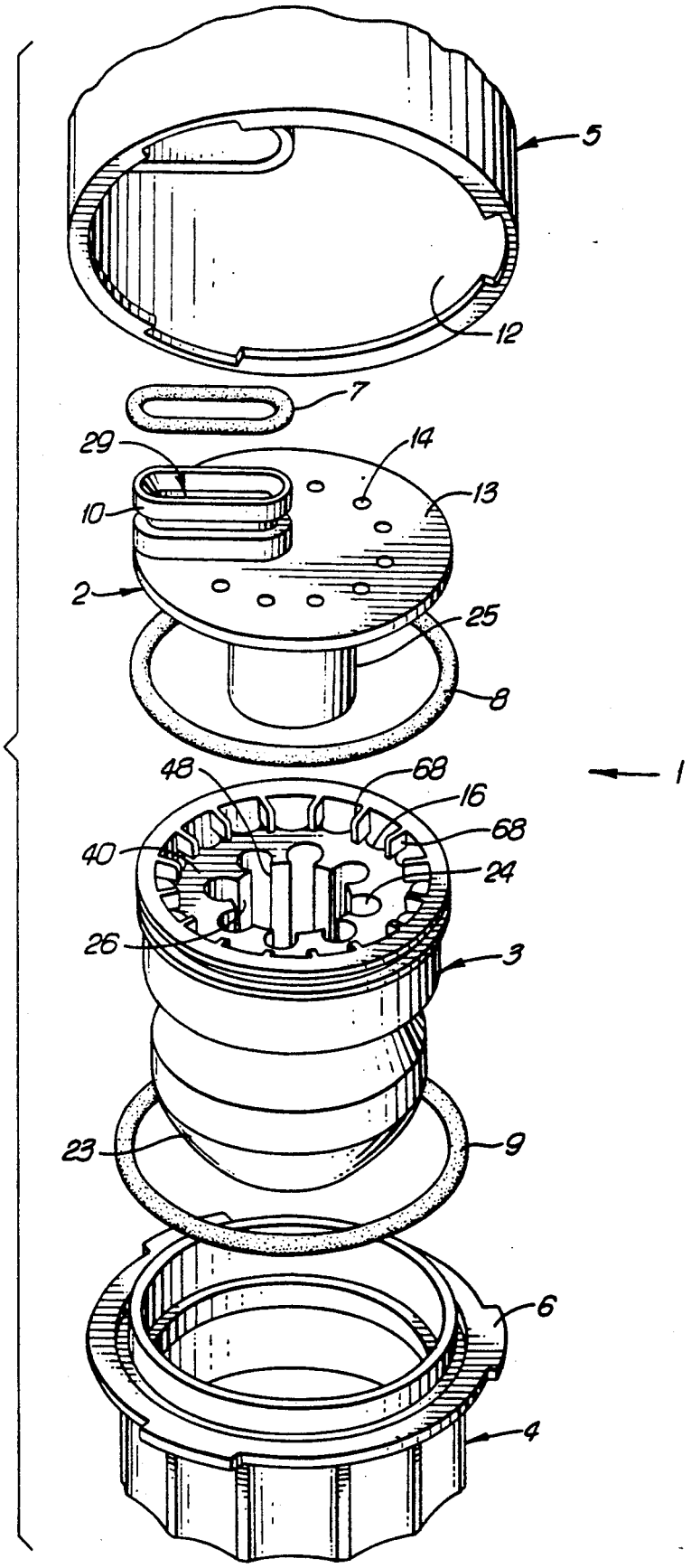
FIG. 2 is an exploded view of the nozzle of FIG. 1.

A high efficiency nozzle for a beverage dispenser in accordance with a preferred embodiment of the present invention is generally indicated at 1 in FIGS. 1 and 2. As shown therein, the nozzle 1 generally includes a syrup tube 2 which fits inside an inner nozzle member 3 which in turn fits inside an outer housing 4. The assembled nozzle 1 is mounted to the bottom portion of a dispensing valve body 5. The nozzle 1 is preferably formed from plastic but may be formed from any suitable material such as stainless steel, and is so formed that it is easily attached to and removed from the dispensing valve body 5. In the illustrated embodiment, flanges 6 provided around the outer periphery of the outer housing 4 are received in a lower channel of the dispensing valve body 5 to retain the assembled nozzle 1 in place. O-rings 7, 8 and 9 may be provided at the top neck portion 10 of the syrup tube 2 and around the outer peripheries of the inner nozzle member 3 to provide sealing.

Figure 3:
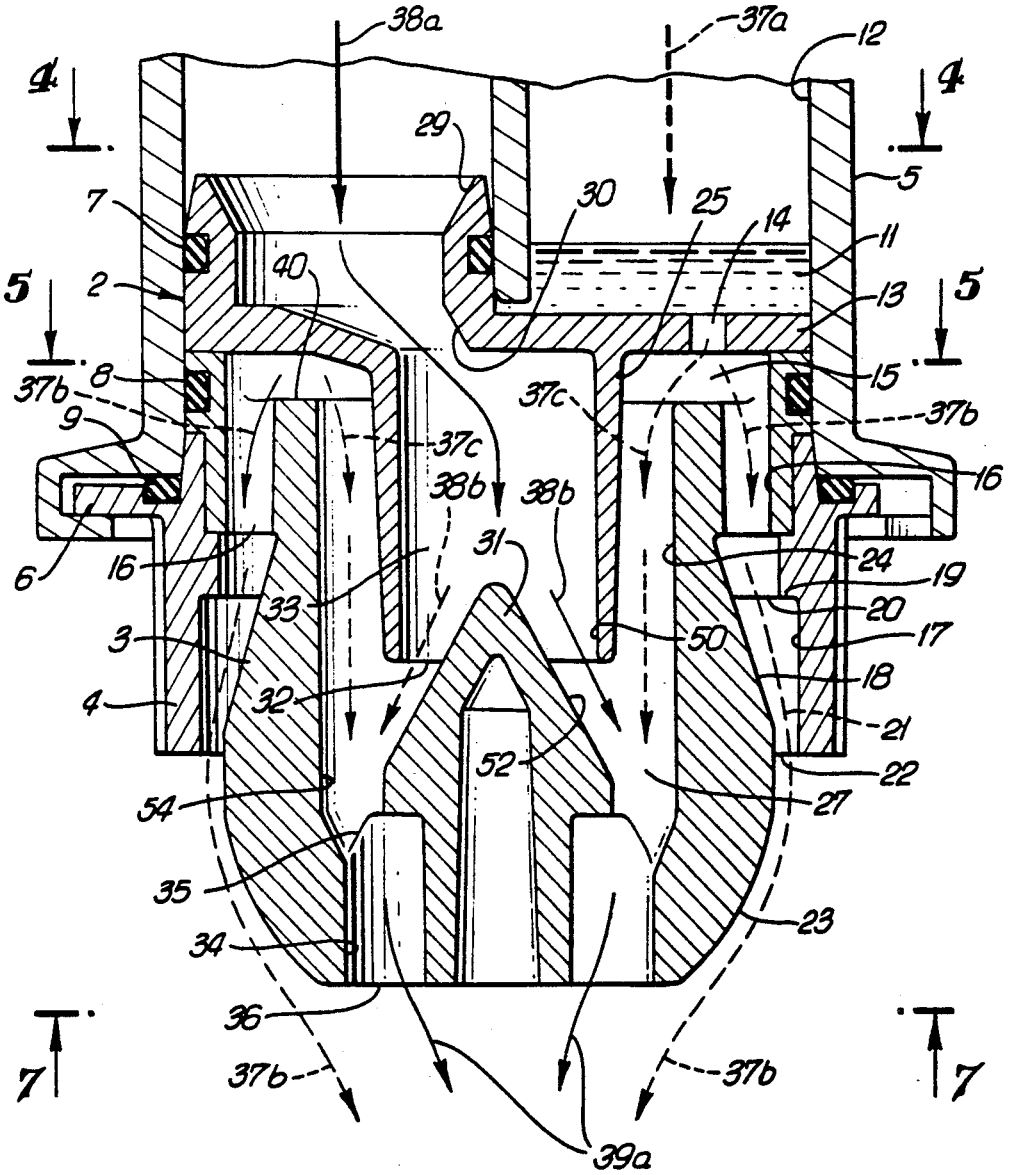
FIG. 3 is a sectional view taken along the lines 3—3 as shown in FIG. 1.
Figure 4:
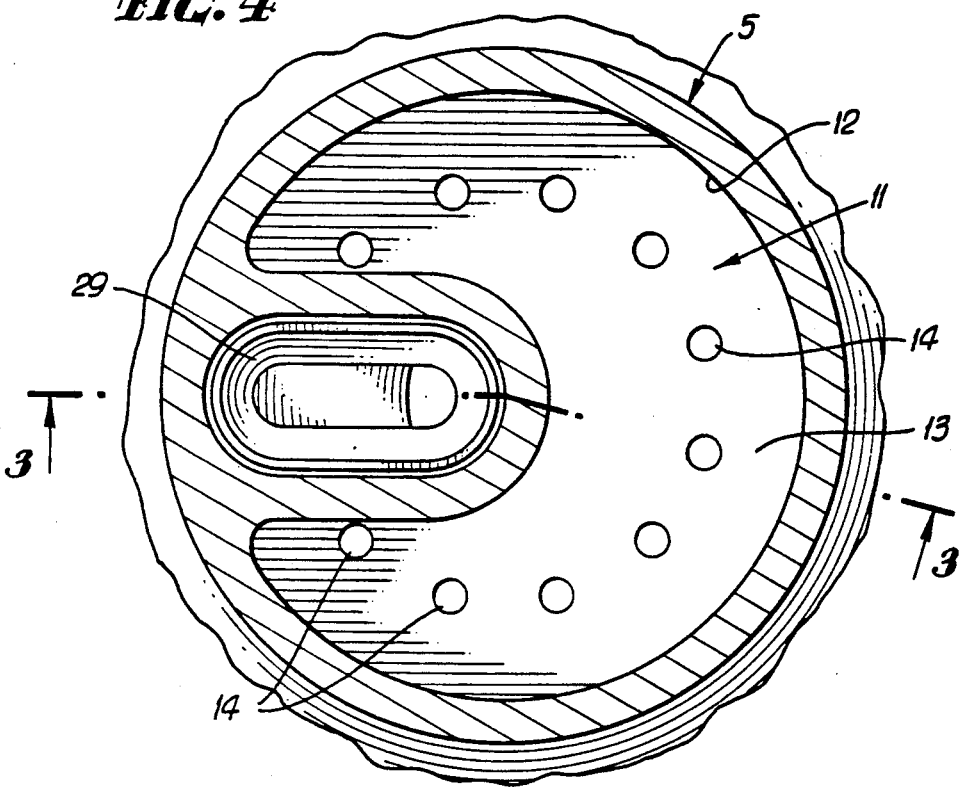
FIG. 4 is a sectional view taken along the lines 4—4 as shown in FIG. 3.
Figure 5:
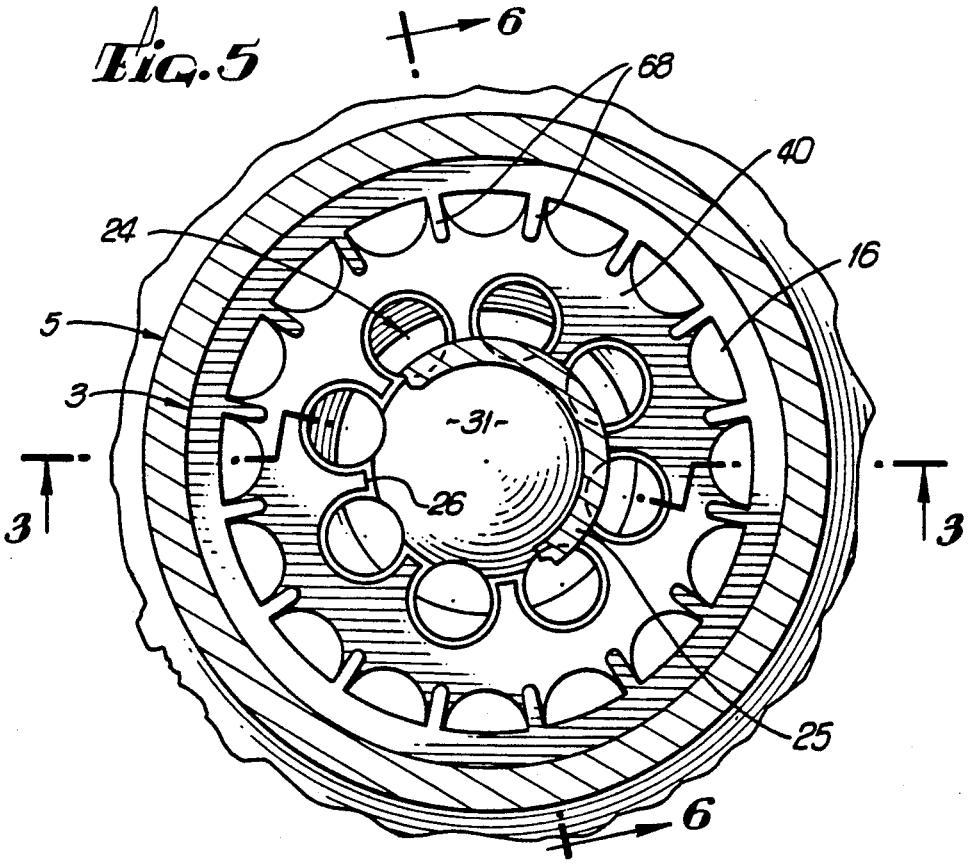
FIG. 5 is a sectional view taken along the lines 5—5 as shown in FIG. 3.

In accordance with one embodiment of the present invention with reference to FIG. 3 and FIG. 5, a liquid such as soda water from the dispensing valve 5 enters (as indicated by a thick dashed arrow 37*a*) a nozzle accumulator chamber 11 which is defined by an annular-shaped wall 12 of the dispensing valve 5 and a flat, disk-shaped diffuser bottom wall 13 (FIG. 2) of the syrup tube 2. In the illustrated embodiment, the diffuser wall has an outsider diameter of 1.69 inches. A plurality of ports 14 are provided through the diffuser wall 13 through which the soda water drains. As shown in FIG. 4, the ports 14 include ten holes arranged in a circular pattern of sufficient size so as to create back pressure which assures that the accumulator chamber 11 fills with soda water at the beginning of each dispense cycle. Thus, the stream of soda water entering the accumulator chamber is directed into an accumulated pool of soda water, thereby significantly reducing the velocity and turbulence of the soda water. As a consequence, the loss of carbon dioxide from the solution is significantly reduced.

Furthermore, the significant reduction in velocity provided by the accumulator chamber 11 allows the diffuser ports 14 to provide a relatively low restriction to the flow of soda water. For a flow rate of six ounces per second, the ports 14 have a total effective cross-sectional area of 0.066 square inches in the illustrated embodiment. Such a size provides a very low pressure loss (on the order of one half p.s.i. across the nozzle), thereby reducing the strain on the control valves of the dispenser.

The ports 14 distribute the soda water evenly inside an annular-shaped separator chamber 15 which is defined by the wall 13 of the syrup tube overlying a top recessed portion 40 of the inner nozzle member 3. The separator chamber 15 directs approximately one half of the soda water as indicated by a thin dashed arrow 37*b* into outer multi-hole straightener conduits or vanes 16 which lead to an outer conduit defined by an internal wall 17 of the outer housing 4 and an external surface 18 of the inner nozzle member 3. The outer straightener vanes 16 further reduce the velocity of the soda water 37*b*, while maintaining an equal and smooth flow of the soda water about the outer surface 18 of the inner nozzle member 3. Vertical partitions 68 between each of the outer straightener vanes 16 have been found to further improve carbon dioxide retention and smooth the flow over the outer surface of the inner nozzle member 3.

A shoulder portion 19 provided on the internal surface of the outer housing 4, and the external surface 18 of the inner nozzle member 3 spaced from the shoulder 19, define an annular-shaped orifice 20 in the outer conduit, which is sized so as to assure that the vanes 16 fill with soda water during dispense time. An outer orifice 21 formed between the internal surface 17 of the outer housing 4 and the external surface 18 of the inner nozzle member 3 assures a thin even film of the soda water around an outer exit 22. The inner nozzle member 3 has a bulb-shaped nozzle cone 23 for which its largest diameter defines the inner wall of its outer exit 22. The cone diameter is gradually reduced toward the bottom of the nozzle cone 23, forming a generally bulb-shaped external surface. The circular film of the soda water, by capillary attraction, follows along the bulb-shaped external surface of the nozzle cone 23 of the inner nozzle member 3 inward and downwardly toward the bottom thereof, which further reduces the downward velocity of the soda water.

As indicated by a dashed arrow 37*c*, the second part (approximately one-half) of the soda water separated at the separator chamber 15, enters inner conduits or inner multi-hole straightener vanes 24 which are each generally cylindrical and are arranged in a circular pattern (FIG. 5) around a central bore 26 of the inner nozzle member 3. As shown in FIG. 2, the central bore 26 overlaps the inner vanes 26 so that the inner vanes 26 are not complete but instead each vane 26 has a longitudinal opening 48 along the inner side.

Figure 6:
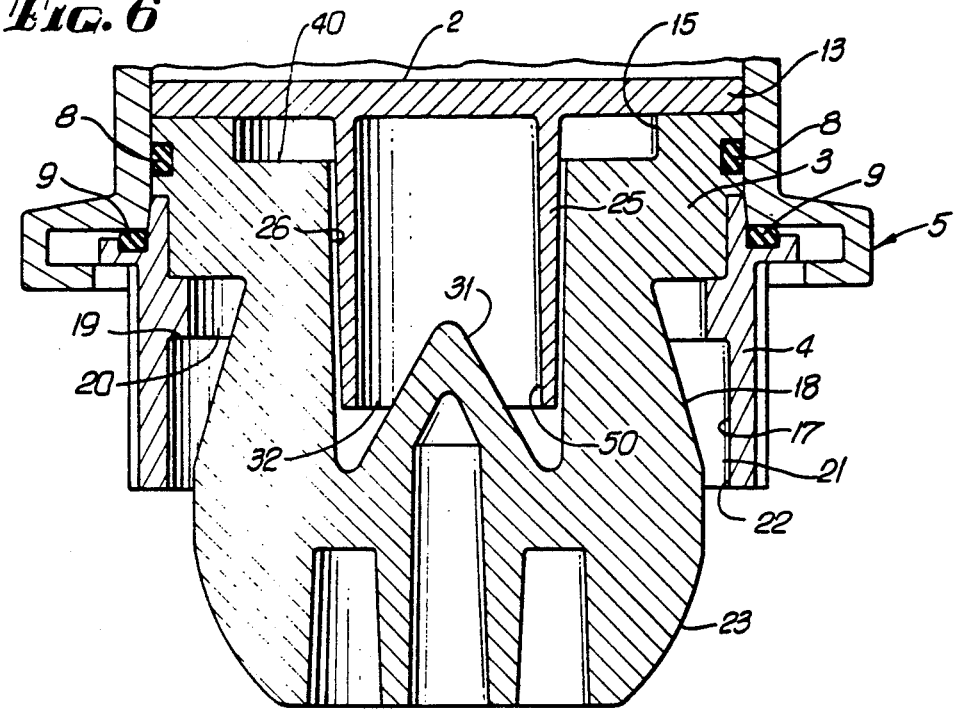
FIG. 6 is a sectional view taken along the lines 6—6 as shown in FIG. 5.
Figure 7:
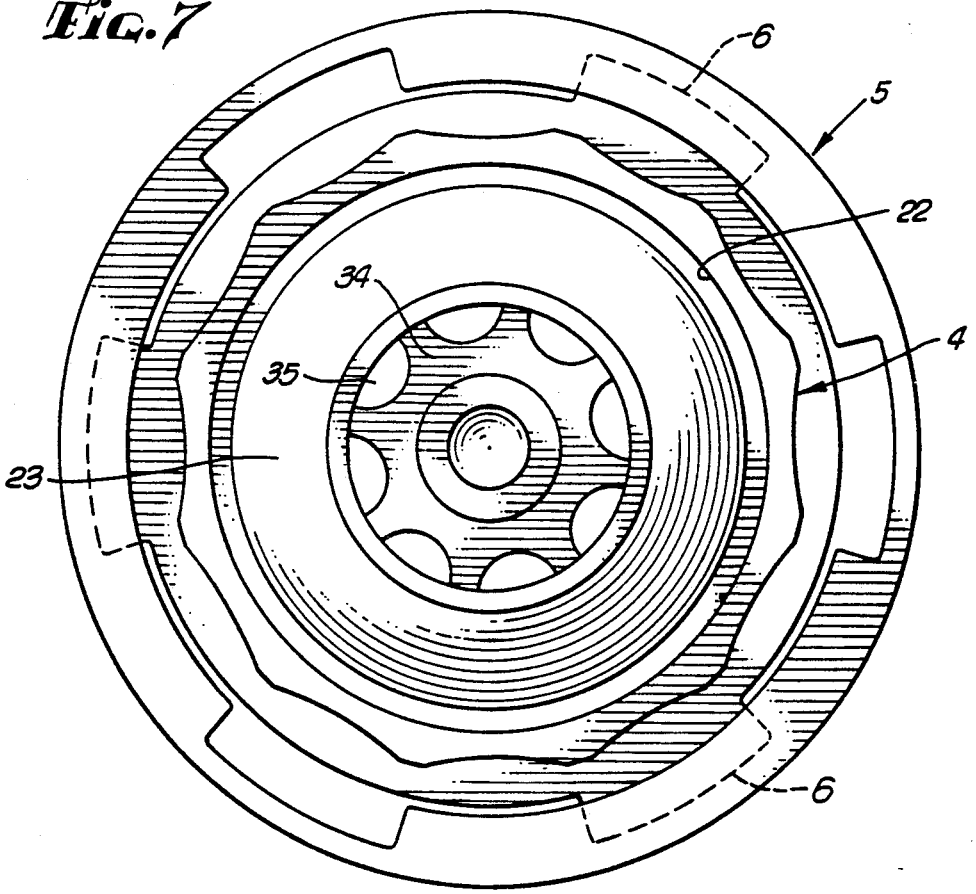
FIG. 7 is a bottom view.

As shown in FIG. 6, the outside diameter of the lower cylindrical portion 25 of the syrup tube 2 is made slightly smaller than the inner diameter of the central bore 26 of the inner nozzle member 3 so that the cylindrical portion 25 is received by the central bore 26 of the inner nozzle member 3 to partially close the upper portion of each inner vane opening 48. A narrow gap between the central bore and the external surface of the cylindrical portion 25 allows a thin circular flow of soda water through the gap. The inner straightener vanes 24 assure an evenly distributed flow of the soda water 37*c* into a mixing chamber 27 which is located at the lower portion of the opening 48 of each of the inner straightener vanes 24. The soda water directed through the inner vanes 24 mixes with the syrup in the mixing chamber 27 as described below.

As represented by a thick solid arrow 38*a*, syrup from the dispensing valve enters the syrup tube 2 at a syrup inlet 29, and is directed down a central bore 50 of the cylindrical portion 25 of the syrup tube 2. As best seen in FIG. 3, a diverter 31 formed by a cone-shaped protrusion is provided at the bottom of the central bore 26 of the inner nozzle member 2. The apex of the protrusion 31 extends into the central bore 50 of the syrup tube 2 to define a syrup reservoir or accumulator chamber 33 having an annular-shaped syrup exit orifice 32 at the bottom of the syrup tube 2. The syrup orifice 32 is sized so that the accumulator chamber 33 within the cylindrical portion 25 of the syrup tube 2 fills with syrup at the beginning of each dispense cycle, and yet substantially empties at the end of each cycle. In the illustrated embodiment, the orifice 32 has a total effective cross-sectional area of 0.109 square inches for a six ounce per second flow rate. This arrangement delays a portion of the syrup from entering the mixing chamber 27, at the start of each cycle, and also allows the syrup to continue to flow, for a short time, at the end of each cycle. Due to the low viscosity of the soda water, the nozzle 1 always empties at the end of each cycle. Therefore the delay of the syrup allows the soda water and the syrup to continue to arrive substantially simultaneously at the mixing chamber 27 during each dispensing cycle, so as to reduce or eliminate stratification at the beginning and end of each cycle.

The base portion 52 (FIG. 3) of the syrup diverter 31 together with the lower portions 54 of the inner vanes 34 adjacent the openings 48 define the mixing chamber 27. The syrup diverter 31 distributes a conically-shaped, even film of syrup as indicated by the solid arrows 38*b* into the mixing chamber 27, where syrup is gently mixed with the soda water 37*c* directed through the inner vanes 24. The diverter 31 has slowed the velocity of the syrup so that the syrup and soda water arrive at the mixing chamber 27 at substantially the same relative velocity.

The inner multi-hole straightener vanes 24 couple the mixing chamber 27 to an annular shaped discharge orifice 34. Because the inner vanes 24 are circumferentially arranged about the inner nozzle member 3, the mixed liquid 39*a* is evenly distributed around the periphery of the discharge orifice chamber 34 at a very low velocity. Because of the annular shape of the discharge orifice 34, the mixed liquid exits the nozzle in a donut-shaped flow pattern. Simultaneously, the soda water 37*b* flowing along the external surface of the nozzle cone 23 discharges from the nozzle 1 in a cone-shaped column which converges with the donut-shaped flow of the soda water and syrup mixture 39*a*. Both the soda water 37*b* and the mixture 39*a* are flowing at substantially the same velocity as they converge.

The above arrangement places an outside ring of soda water around the previously mixed inside liquid thereby allowing any $CO_2$ which is not in solution to escape before the outside ring of soda water is mixed with the syrup. As a consequence, foam height is reduced. The outside ring of soda water and the inside ring of the soda water and syrup mixture, mix during the fall from the exit of the nozzle to a dispensing container, and also mix as they come into contact with the container and fill the container.

It has been found that such an arrangement allows improved mixing (i.e. low stratification) while reducing foaming and retaining high carbonation, even at high flow rates of 6 ounces per second. The nozzle reduces the high upstream velocity of the soda water to a very low velocity without an attendant high pressure loss across the nozzle. In addition, high upstream liquid velocities are reduced in a gradual and gentle manner to increase carbonation retention and to reduce the fall rate of the liquid as it leaves the nozzle. As a consequence, the amount of shock and vibration to the beverage as it strikes the dispensing container, is reduced thereby reducing foam height and carbonation loss. As a result, a high flow rate (approximately 6 oz/sec or more) has been achieved while maintaining a high quality beverage.

Figure 8:
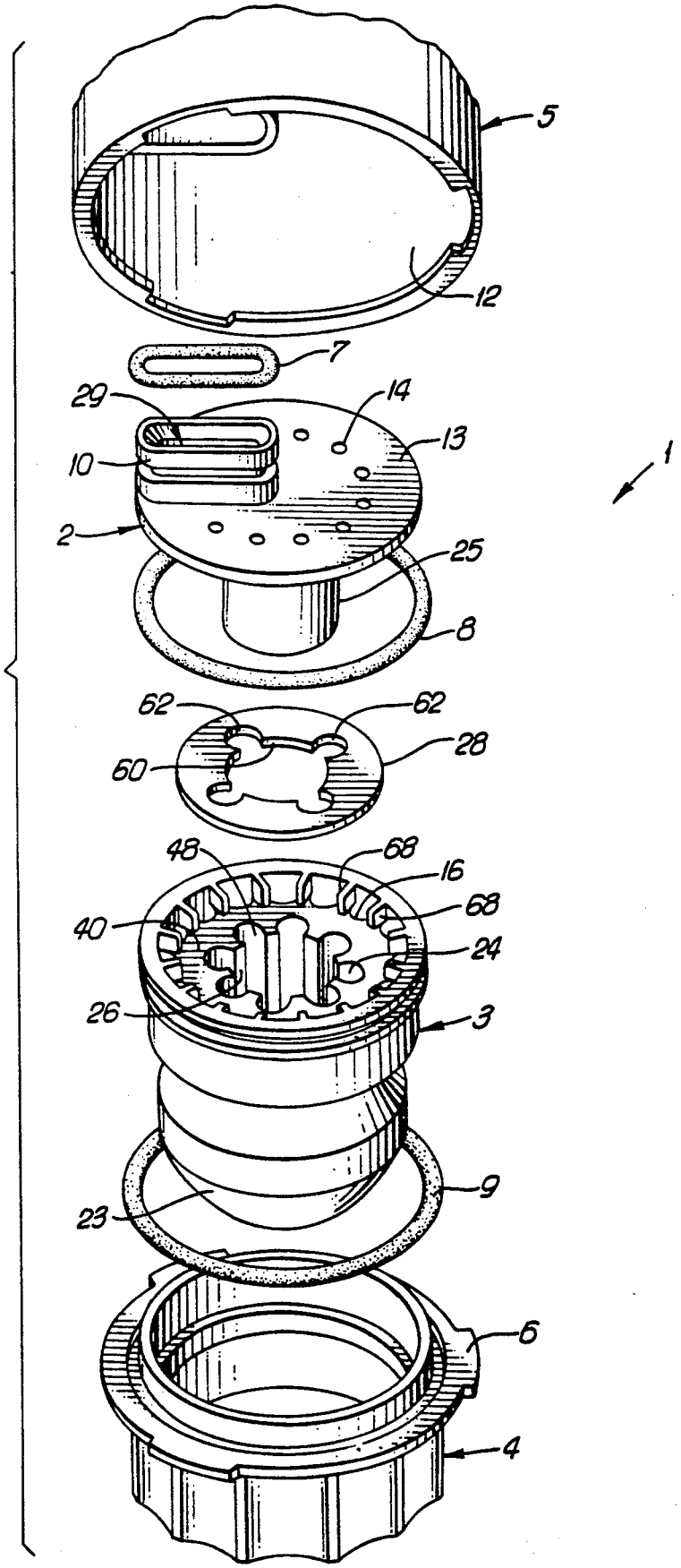
FIG. 8 is an exploded view of another embodiment of the nozzle of FIG. 1.

With reference to FIG. 8, a low flow rate alternative embodiment is depicted. A circular disk 28 may be placed in the separator chamber 15 over the top surface of the inner nozzle member 3 when it is desired to reduce the quantity of soda water flowing into the inner straightener vanes 11, for example from 6 oz/sec to 3 oz/sec. The circular disk 28 has a central bore 60 sized to receive the lower cylindrical portion 25 of the syrup tube 2. The disk 28 also has four circular recesses 62 provided around the periphery the central bore of the disk 28. The four circular recesses 62 are arranged to register with four of the eight inner straightener vanes 24 so that the quantity of soda water flowing into the inner straightener vanes and to the mixing chamber 27 is reduced.

While preferred embodiments of the invention have been described, it should be appreciated that variations thereof will be perceived by those skilled in the art. As such, the scope of the invention should be defined by the claims appended hereto.

I claim:

1. A nozzle for a beverage dispenser for dispensing a beverage comprising a first liquid and a second liquid comprising:

separating means for separating the first liquid into a first portion and a second portion;

first mixing means for forming a mixture of the second liquid and the first portion of the first liquid;

second mixing means for mixing said mixture and the second portion of the first liquid; and inlet conduit means for the second liquid having an inlet and an outlet and a diverter provided therein having an apex at its top and a base at its bottom with its apex being directed to the outlet of the inlet conduit means.

2. A nozzle for a beverage dispenser for dispensing a beverage comprising a first liquid and a second liquid comprising:

separating means for separating the first liquid into a first portion and a second portion;

first mixing means for forming a mixture of the second liquid and the first portion of the first liquid;

second mixing means for mixing said mixture and the second portion of the first liquid;

accumulator chamber means having a wall which defines a port being sized s that the exit rate of the first liquid is less than the entering rate so that the accumulator chamber accumulates the first liquid during a part of the dispense cycle; and inlet conduit means for the second liquid having an inlet and an outlet and a cone-shaped protrusion provided therein having an apex at its top and a base at its bottom with its apex being directed to the outlet of the inlet conduit means.

3. In nozzle for beverage dispenser having a source of a first liquid and a source of a second liquid for dispensing a beverage comprising the first liquid and the second liquid, the improvement comprising a first conduit having an inlet coupled to the first liquid source and an outlet; a second conduit for the second liquid having an inlet coupled to the second liquid s and outlet; and a cone-shaped shaped protrusion having at its top and base at its bottom with its base being located adjacent the first liquid conduit outlet and its apex being directed toward the outlet of the second conduit for evenly distributing the second liquid about the circumference of the cone-shaped protrusion to mix the second liquid with the first liquid, said protrusion being spaced from the second conduit outlet so to restrict the second conduit outlet to delay the outflow of the second liquid from the second conduit outlet and to define a accumulator chamber for the delayed second liquid in the second conduit.

4. A nozzle in a beverage dispenser for mixing a plurality of liquids in a dispense cycle, comprising:

an accumulator chamber for a first liquid entering at a first rate during the dispense cycle, and an outlet which includes a wall which defines a plurality of spaced orifices arranged in a circular pattern, said orifices being sized so that the exit rate of the first liquid is less than the entering rate so that the accumulator chamber accumulates the first liquid during a part of the dispense cycle;

a separator chamber having an inlet coupled to the outlet of the accumulator chamber, said separator chamber having inner and outer outlets to separate the first liquid into inner and outer portions, each separator chamber outlet including a wall which defines a plurality of spaced orifices arranged in a circular pattern with the separator chamber outer outlet orifices being positioned outside the circular pattern of the inner outlet orifices;

a body having a bulb-shaped outer surface, an annular-shaped discharge orifice centrally located at the bottom of the body and an interior cavity which defines a cone-shaped protrusion having an apex at its top and a base at its bottom;

a plurality of outer conduits for the first liquid outer portion, each outer conduit having an inlet coupled to a separator chamber outer outlet orifice and an outlet directed at the bulb-shaped outer surface of the body, said outer conduit outlets being circumferentially arranged about the body so that the first liquid outer portion is directed to flow downwardly about the circumference of the bulb-shaped outer surface of the body toward the discharge orifice of the body;

an inlet conduit for the second liquid having an outlet directed at the apex of the cone-shaped protrusion so that the second liquid flows downwardly about the circumference of the cone-shaped protrusion; and a plurality of inner conduits for the first liquid inner portion, each inner conduit having a first inlet coupled to a separator chamber inner outlet orifice, a second inlet coupled to the body cavity adjacent the base of the cone-shaped protrusion and an outlet coupled to the discharge orifice of the body, said inner conduit second inlets being circumferentially arranged about the base of the cone-shaped protrusion so that the second liquid is directed to flow into the inner conduit second inlets and be mixed with the first liquid inner portion in the plurality of inner conduits;

wherein the mixture of the first liquid inner portion and the second liquid is discharged from the bottom discharge orifice of the body in a central column and the first liquid outer portion is discharged from the nozzle in a cone-shaped column around the central mixture column.

5. The nozzle of claim 4 further comprising inside channel blocking means provided in the separator chamber for reducing the flow quantity of the first portion of the first liquid flowing into the inner conduits.

* * * * *